US011771169B2

(12) United States Patent
Ginguenaud et al.

(10) Patent No.: US 11,771,169 B2
(45) Date of Patent: Oct. 3, 2023

(54) HEARING PROTECTION DEVICE

(71) Applicant: MSA Europe GmbH, Jona (CH)

(72) Inventors: Clément Ginguenaud, Tassin la demi-lune (FR); Amaury Sicre, Lyons (FR); Alois Chabanne, Ambérieu-en-Bugey (FR); Nicolas Prely, Massieux (FR)

(73) Assignee: MSA Europe GmbH, Jona (CH)

( * ) Notice: Subject to any disclaimer, the term of this patent is extended or adjusted under 35 U.S.C. 154(b) by 320 days.

(21) Appl. No.: 17/253,203

(22) PCT Filed: Jun. 18, 2019

(86) PCT No.: PCT/EP2019/066101
§ 371 (c)(1),
(2) Date: Dec. 17, 2020

(87) PCT Pub. No.: WO2020/007606
PCT Pub. Date: Jan. 9, 2020

(65) Prior Publication Data

US 2021/0267299 A1 Sep. 2, 2021

(30) Foreign Application Priority Data

Jul. 6, 2018 (FR) ..... 18/56219

(51) Int. Cl.
*A42B 3/16* (2006.01)

(52) U.S. Cl.
CPC ..... *A42B 3/166* (2013.01)

(58) Field of Classification Search
CPC .. A61F 11/06; A61F 11/14; F41H 1/04; F41H 1/06; F41H 1/08; A42B 3/0406;
(Continued)

(56) References Cited

U.S. PATENT DOCUMENTS 3,461,463 A * 8/1969 Beguin ..... A42B 3/166 381/376
4,186,447 A 2/1980 Paimaer
(Continued)

FOREIGN PATENT DOCUMENTS

FR 2395745 A1 1/1979
FR 2532838 A1 11/1984
(Continued)

*Primary Examiner* — Katherine M Moran
(74) *Attorney, Agent, or Firm* — Jones Day

(57) ABSTRACT

A hearing protection device has a base (11) configured for connecting to a lateral portion of a protective helmet (1), an ear cup (20) configured for covering an ear of a user, and a support (30) connecting the ear cup (20) to the base (11). The support (30) has a first arm (31) and a second arm (32) each having an upper part connected to the base (11) by at least one connection member (50) and a lower part connected to the ear cup (20). The at least one connection member (50) is elastically deformable to allow relative movement of the upper part of the first arm (31) relative to the upper part of the second arm (32). The hearing protection device is movable between an active position, in which the ear cup (20) is configured to cover the ear of the user, and an inactive position, in which the ear cup (20) is configured to be spaced apart from the ear of the user.

21 Claims, 4 Drawing Sheets

(58) Field of Classification Search
CPC ..... A42B 3/16; A42B 3/163; A42B 3/166; H04R 5/033; H04R 5/035
USPC ..... 2/209
See application file for complete search history.

(56) References Cited

U.S. PATENT DOCUMENTS

| | | | | |
|---|---|---|---|---|
| 4,224,694 | A | 9/1980 | Paimaer | |
| 4,347,631 | A * | 9/1982 | Newcomb | A42B 3/166 381/189 |
| 2007/0226865 | A1 | 10/2007 | Lindgren | |
| 2010/0281605 | A1 * | 11/2010 | Pereira | A42B 3/166 2/209 |
| 2013/0219598 | A1 * | 8/2013 | Pfanner | A42B 3/16 2/423 |
| 2017/0049179 | A1 | 2/2017 | Nordin et al. | |
| 2019/0021910 | A1 * | 1/2019 | Pfanner | H04R 1/04 |
| 2019/0075879 | A1 * | 3/2019 | Persson | A61F 11/14 |
| 2020/0170329 | A1 * | 6/2020 | Bohn | A42B 3/185 |
| 2022/0295934 | A1 * | 9/2022 | Adams | A42B 3/166 |

FOREIGN PATENT DOCUMENTS

| | | | | |
|---|---|---|---|---|
| JP | S55155835 | U | 2/1954 | |
| WO | WO-2013075166 | A1 * | 5/2013 | A61F 11/14 |
| WO | 2015167924 | A1 | 11/2015 | |

* cited by examiner

HEARING PROTECTION DEVICE

CROSS-REFERENCE TO RELATED APPLICATIONS

This application is the United States national phase of International Application No. PCT/EP2019/066101 filed Jun. 18, 2019, and claims priority to French Patent Application No. 18/56219, filed Jul. 6, 2018, the disclosures of which are hereby incorporated in their entirety.

BACKGROUND OF THE DISCLOSURE

Field of the Disclosure

The present disclosure relates generally to a hearing protection device, and in particular to a protective helmet having a pair of hearing protection devices.

Description of Related Art

Certain jobs or activities require the protection of the person who practices them, and more specifically: the protection of the head, by wearing a helmet shell, and the protection against noise, by wearing a hearing protection device.

In particular, there are known complete helmet systems including a head protection shell on which is mounted, on both sides, a hearing protection device. Such a hearing protection device is generally composed of a base that is assembled to the shell, of an ear cup to cover an ear of the user, and of a support linking the base and the ear cup.

An interesting feature of these complete systems lies in the possibility of placing the cups in the active position, that is to say pressed around the ears, or in the inactive position, that is to say, raised and spaced from the ears. The inactive position allows, especially when the noise against which it is desired to be protected is no longer present, on the one hand, avoiding unnecessary and potentially unpleasant pressure of the cups against the face and, on the other hand, facilitating discussions between people, which are difficult or even impossible when the cups cover the ears.

Among these known systems, some provide that the support is rigid. Such a configuration is not fully satisfactory from the point of view of hearing protection. Indeed, the rigidity of the support results in a poor adaptability to the diversity of the shapes of the users' face. As the cups cannot always press properly against the face around the ears, their acoustic attenuation capacity is greatly diminished.

Other known systems provide that the support is formed of a metallic wire. The flexibility of this wire allows a better adaptation to the shape of the wearer's face, and therefore ensures a good quality of the hearing protection. However, switching between active and inactive positions is complicated, because the flexibility of the wire can generate deformations and offsets between parts that can block the movement or degrade its smoothness. In practice, it is often necessary for the user to maneuver the hearing protection device with one hand to switch it from one position to the other, but also to ensure maintenance and guidance with the other hand, to overcome the problems resulting from the flexibility of the support.

SUMMARY OF THE DISCLOSURE

The present invention aims at overcoming all or part of the drawbacks mentioned above. In some non-limiting embodiments or aspects, provided is a hearing protection device that can be adapted to the face of the user, therefore efficient from an acoustic point of view. In some non-limiting embodiments or aspects, provided is a hearing protection device that allows a satisfactory displacement between an active position and an inactive position.

According to a first aspect, the invention concerns a hearing protection device, comprising:

a base equipped with means for assembly to a lateral portion of a protective helmet shell, and including a bearing face on said shell;

an ear cup able to cover one ear of a user;

a support linking the base and the ear cup;

wherein the support is formed of two distinct arms, the arms having an upper part connected to the base by a connection device and a lower part connected to the ear cup, the connection device comprising at least one connection member connecting at least one of the arms to the base, said connection member being semi-rigid, and being configured to ensure that the arm is maintained relative to the base and to be elastically deformed so as to allow relative movement of the upper part of the arm relative to the upper part of the other arm substantially orthogonally to the bearing face of the base.

By providing a support which is no longer monolithic but including two distinct arms, as well as a connection member allowing relative displacement between these two arms, the hearing protection device according to the invention has a great adaptability to the face of the user. Concretely, the relative displacement between the two arms can cause a movement of the cup substantially according to a rotation about a vertical axis (in the neutral position of use, that is to say when the device is worn and in the active position, without offset between the arms orthogonally to the bearing face of the base). The amplitude of this rotation can be in the range of −10° to +10°, or even of −15° to +15°.

Furthermore, according to one possible embodiment, the arms can be rigid, which ensures a smooth and easy switching between an active position and an inactive position of the ear cups.

It can be provided that the upper part of each of the two arms is connected to the base by at least one connection member. According to this embodiment, there are two connection members (one associated to each arm), or a single connection member (common to both arms). Alternatively, only one of the two arms could be connected to the base, by its upper part, via a semi-rigid connection member, while the other arm would be connected to the base, by its upper part, in a different manner.

The or each connection member can include at least one branch assembled to the base, one branch assembled to the upper part of an arm, and one junction portion linking the two branches, the two branches preferably being substantially parallel.

The or each connection member can be substantially planar. The or each connection member can be located in a plane substantially parallel to the bearing face of the base, at least in the inactive position. The or each connection member can have a disc-shaped section.

According to one possible embodiment, the connection device comprises a loop-shaped connection member having a first branch assembled to the base and a second branch assembled to the upper part of each of the two arms, said second branch having a through-slot located between the two arms. The slot allows the relative movement of the upper parts of the arms relative to each other. For example, this connection member is unique. It can have the shape of an oblong loop.

According to another possible embodiment, the connection device comprises two distinct connection members, each connection member being U-shaped and having a first branch assembled to the base and a second branch assembled to the upper part of one of the two arms. The two arms are therefore more independent of each other, while remaining connected by the cup. Preferably, the two U are located in a same plane and are open towards each other.

According to one embodiment, the arms are rigid, and the connection device is configured:

to allow the arms to be movable relative to the base between: an active position, in which the ear cup is able to be in contact with the face of the user and to cover one of his ears; and an inactive position, in which the ear cup is able to be located at a distance from the face;

and to maintain the arms in one or the other of these positions in stable equilibrium.

Maintaining the arms in the active or inactive position, in stable equilibrium, means that if the arms are slightly deviated from said position, they tend to return to it. However, the intermediate positions between the active position and the inactive position are unstable. This may be due to the fact that the connection member is compressed and tends to act on the arms in order to displace them to one of their stable equilibrium positions.

The hearing protection device can further comprise an abutment system configured to limit displacement of the arms relative to the base beyond the active position and/or beyond the inactive position. This abutment system can include a finger formed on the base and engaged in a cavity formed in at least one arm (or the opposite configuration), the cavity having a dihedral shape having an upper face and a lower face respectively forming an abutment in the active position and an abutment in the inactive position.

The or each connection member can have a portion clipped into a groove of the base and a portion clipped into a groove of the upper part of the arm, so that each of the portions of the connection member can pivot in the corresponding groove, about the axis of the groove. Such a configuration allows easily switching between active and inactive positions, maintaining the device in one or the other of these positions in a stable manner, and creating unstable intermediate positions.

For example, said portion of the connection member may be a branch of the connection member, as previously defined.

According to one possible embodiment, the connection member is fixed inside the base, in the upper part of the base, and the lower face of the base includes at least one orifice in which the arms are engaged, said orifice(s) being large enough to allow relative movement between the upper parts of the arms—under normal conditions of use.

Each arm can have:

a rectilinear portion extending from the base to the ear cup;

and a curved portion which extends the rectilinear portion and whose lower end is connected to the ear cup pivotally about a substantially longitudinal axis.

The rectilinear portion may be substantially planar.

The rectilinear portion may be substantially located in a longitudinal plane in the neutral position of use. By this is meant that the plane of the rectilinear portion may be longitudinal vertical or inclined relative to a longitudinal vertical plane by an angle less than 30°, for example in the order of 20°, while extending away from the head of the user from top to bottom.

The rectilinear portions of the two arms may be substantially coplanar.

The rectilinear portions of the two arms may be substantially adjacent, that is to say that their edges which are facing each other in the longitudinal direction are spaced by less than 5 mm, preferably less than 3 mm apart, in the neutral position of use.

The curved portions of the two arms preferably form an arch around the cup.

According to one possible embodiment, at least one arm has an appendage arranged outside the base, the appendage having a face located opposite and in close proximity to an outer face of the base, said faces of the appendage and of the base preferably having complementary shapes, said appendage being configured to guide the relative movement of said arm relative to the other arm.

The appendage can be configured to prevent rotation of the arm including the appendage relative to the base about a transverse axis, in the neutral position of use.

According to a second aspect, the invention concerns a protective helmet comprising a shell intended to protect the head of a user, as well as two hearing protection devices as previously described, each assembled to a lateral portion of the shell.

In accordance with some non-limiting embodiments or aspects of the present disclosure, a hearing protection device may have a base configured for connecting to a lateral portion of a protective helmet, an ear cup configured for covering an ear of a user, and a support connecting the ear cup to the base. The support may have a first arm and a second arm each having an upper part connected to the base by at least one connection member and a lower part connected to the ear cup. The at least one connection member may be elastically deformable to allow relative movement of the upper part of the first arm relative to the upper part of the second arm.

In accordance with some non-limiting embodiments or aspects of the present disclosure, the hearing protection device may be movable between an active position, in which the ear cup is configured to cover the ear of the user, and an inactive position, in which the ear cup is configured to be spaced apart from the ear of the user. The at least one connection member may be configured to maintain the first and second arms in one of the active position or the inactive position in stable equilibrium. The hearing protection device may be further movable to an intermediate position between the active position and the inactive position, where the hearing protection device is in an unstable equilibrium in the intermediate position such that movement of the hearing protection device in a direction toward the active position or the inactive position may automatically move the hearing protection device from the intermediate position to the active position or the inactive position. Each of the first arm and the second arm may have a rectilinear portion extending from the base in a direction toward the ear cup, and a curved portion extending from the rectilinear portion. A lower end of the curved portion may be pivotally connected to the ear cup.

In accordance with some non-limiting embodiments or aspects of the present disclosure, the at least one connection member may have a first branch connected to the base, a pair of junction portions connected to opposing ends of the first branch, and a second branch connected to the pair of junction portions. The second branch may have a through slot separating the second branch into a first branch portion and a second branch portion. The first branch may be retained in a groove on the base such that the first branch is pivotable about a first axis. The first branch portion of the second branch may be retained in a groove on the first arm and the second branch portion of the second branch may be retained in a groove on the second arm such that the second branch is pivotable about a second axis different from the first axis. The at least one first branch and the second branch may be substantially parallel.

In accordance with some non-limiting embodiments or aspects of the present disclosure, an abutment system may be configured to limit displacement of the first and second arms relative to the base beyond at least one of the active position or the inactive position. The abutment system may have a finger formed on the base and engaged in a cavity formed in at least one of the first arm and the second arm. The cavity may have a dihedral shape having an upper face and a lower face respectively forming a first abutment in the active position and a second abutment in the inactive position. One of the first arm and the second arm may have an appendage arranged outside the base and configured to guide a movement of one of the first arm and the second relative to the other of the first arm and the second arm.

In accordance with some non-limiting embodiments or aspects of the present disclosure, a protective helmet may have a shell and a pair of hearing protection devices connected to opposing lateral portions of the shell. Each hearing protection device may have a base connected to one of the lateral portions of the shell, an ear cup configured for covering an ear of a user, and a support connecting the ear cup to the base. The support may have a first arm and a second arm each having an upper part connected to the base by at least one connection member and a lower part connected to the ear cup. The at least one connection member may be elastically deformable to allow relative movement of the upper part of the first arm relative to the upper part of the second arm.

In accordance with some non-limiting embodiments or aspects of the present disclosure, the hearing protection device may be movable between an active position, in which the ear cup is configured to cover the ear of the user, and an inactive position, in which the ear cup is configured to be spaced apart from the ear of the user. The at least one connection member may be configured to maintain the first and second arms in one of the active position or the inactive position in stable equilibrium. Each hearing protection device may be further movable to an intermediate position between the active position and the inactive position. Each hearing protection device may be in an unstable equilibrium in the intermediate position where movement of the hearing protection device in a direction toward the active position or the inactive position automatically may move the hearing protection device from the intermediate position to the active position or the inactive position.

In accordance with some non-limiting embodiments or aspects of the present disclosure, each of the first arm and the second arm may have a rectilinear portion extending from the base in a direction toward the ear cup, and a curved portion extending from the rectilinear portion, with a lower end of the curved portion being pivotally connected to the ear cup. The at least one connection member may have a first branch connected to the base, a pair of junction portions connected to opposing ends of the first branch, and a second branch connected to the pair of junction portions. The second branch may have a through slot separating the second branch into a first branch portion and a second branch portion.

In accordance with some non-limiting embodiments or aspects of the present disclosure, the first branch may be retained in a groove on the base such that the first branch is pivotable about a first axis, and the first branch portion of the second branch may be retained in a groove on the first arm and the second branch portion of the second branch is retained in a groove on the second arm such that the second branch is pivotable about a second axis different from the first axis.

In accordance with some non-limiting embodiments or aspects of the present disclosure, an abutment system may be configured to limit displacement of the first and second arms relative to the base beyond at least one of the active position or the inactive position. The abutment system may have a finger formed on the base and engaged in a cavity formed in at least one of the first arm and the second arm. The cavity may have a dihedral shape having an upper face and a lower face respectively forming a first abutment in the active position and a second abutment in the inactive position.

In further embodiments or aspects, the hearing protection can be further characterized by one or more of the following numbered clauses.

Clause 1: A hearing protection device, comprising: a base (11) equipped with means for assembly (12) to a lateral portion (4) of a protective helmet (1) shell (2), and including a bearing face (13) on said shell (2); an ear cup (20) able to cover an ear of a user; a support (30 linking the base (11) and the ear cup (20), wherein the support is formed of two distinct arms (31, 32), the arms (31, 32) having an upper part connected to the base (11) by a connection device and a lower part connected to the ear cup (20), the connection device comprising at least one connection member (50) connecting at least one of the arms (31, 32) to the base (11), the at least one connection member (50) being semi-rigid, and being configured to ensure that the arm (31, 32) is maintained relative to the base (11) and to be elastically deformed so as to allow relative movement of the upper part of the arm (31, 32) relative to the upper part of the other arm (32, 31) substantially orthogonally to the bearing face of the base (11).

Clause 2: The hearing protection device according to clause 1, wherein the upper part of each of the two arms (31, 32) is connected to the base (11) by the at least one connection member (50).

Clause 3: The hearing protection device according to clause 1 or 2, wherein the at least one connection member (50) includes at least one first branch (51) assembled to the base (11), a second branch (52) assembled to the upper part of an arm (31, 32), and one junction portion (54) linking the at least one first branch and the second branch (51, 52), wherein the at least one first branch and the second branch (51, 52) are substantially parallel.

Clause 4: The hearing protection device according to any of clauses 1-3, wherein the connection device comprises a loop-shaped connection member (50) having a first branch (51) assembled to the base (11) and a second branch (52) assembled to the upper part of each of the two arms (31, 32), and wherein the second branch (52) has a through-slot (53) located between the two arms (31, 32).

Clause 5: The hearing protection device according to any of clauses 1-4, wherein the connection device comprises two distinct connection members (50), each connection member (50) being U-shaped and having a first branch assembled to the base (11) and a second branch assembled to the upper part of one of the two arms (31, 32).

Clause 6: The hearing protection device according to any of clauses 1-5, wherein the arms (31, 32) are rigid, and wherein the connection device is configured: to allow the arms (31, 32) to be movable relative to the base (11) between: an active position, in which the ear cup (20) is configured to contact the face of the user and to cover one of his ears; and an inactive position, in which the ear cup (20) is configured to be located at a distance from the face; and to maintain the arms (31, 32) in one of the active position or the inactive position in stable equilibrium.

Clause 7: The hearing protection device according to any of clauses 1-6, further comprising an abutment system configured to limit displacement of the arms (31, 32) relative to the base (11) beyond at least one of the active position or the inactive position, the abutment system including a finger (45) formed on the base (11) and engaged in a cavity (46) formed in at least one arm (31, 32), the cavity (46) having a dihedral shape having an upper face (47) and a lower face (48) respectively forming an abutment in the active position and an abutment in the inactive position.

Clause 8: The hearing protection device according to any of clauses 1-7, wherein the at least one connection member (50) has a portion (51) clipped into a groove (18) of the base (11) and a portion (52) clipped into a groove (38) of the upper part of the arm (31, 32), so that each of the portions (51, 52) of the connection member (50) can pivot in the corresponding groove (18, 38) about an axis of the corresponding groove.

Clause 9: The hearing protection device according to any of clauses 1-8, wherein the at least one connection member (50) is fixed inside the base (11) in the upper part of the base (11), and wherein the lower face of the base (11) includes at least one orifice (15) in which the arms (31, 32) are engaged, the orifice(s) (15) being large enough to allow relative movement between the upper parts of the arms (31, 32).

Clause 10: The hearing protection device according to any of clauses 1-9, wherein each arm (31, 32) has: a substantially planar rectilinear portion (33) extending from the base (11) to the ear cup (20), the rectilinear portions (33) of the two arms (31, 32) being substantially adjacent; and a curved portion (34) which extends from the rectilinear portion (33) and whose lower end is connected to the ear cup (20) pivotally about a substantially longitudinal axis (A20), the curved portions (34) of both arms (31, 32) forming an arch around the ear cup (20).

Clause 11: The hearing protection device according to any of clauses 1-10, wherein at least one arm (31, 32) has an appendage (41) arranged outside the base (11), the appendage (41) having a face (42) located opposite and in close proximity to an outer face (14) of the base (11), the face (42, 14) of the appendage (41) and the outer face of the base (11) having complementary shapes, the appendage (41) being configured to guide the relative movement of said arm (31, 32) relative to the other arm (31, 32).

Clause 12: The hearing protection device according to any of clauses 1-11, wherein the appendage (41) is configured to prevent rotation of the arm (31, 32) and the appendage (41) relative to the base (11) about a transverse axis in a neutral position of use.

Clause 13: A protective helmet comprising: a shell (2) configured to protect the head of a user; and two hearing protection devices (10) according to claim 41, each assembled to a lateral portion of the shell (2).

Clause 14. A hearing protection device, comprising: a base configured for connecting to a lateral portion of a protective helmet; an ear cup configured for covering an ear of a user; and a support connecting the ear cup to the base, wherein the support has a first arm and a second arm each having an upper part connected to the base by at least one connection member and a lower part connected to the ear cup, and wherein the at least one connection member is elastically deformable to allow relative movement of the upper part of the first arm relative to the upper part of the second arm.

Clause 15. The hearing protection device according to clause 14, wherein the hearing protection device is movable between an active position, in which the ear cup is configured to cover the ear of the user, and an inactive position, in which the ear cup is configured to be spaced apart from the ear of the user.

Clause 16. The hearing protection device according to clause 14 or 15, wherein the at least one connection member is configured to maintain the first and second arms in one of the active position or the inactive position in stable equilibrium.

Clause 17. The hearing protection device according to any of clauses 14-16, wherein the hearing protection device is further movable to an intermediate position between the active position and the inactive position, and wherein the hearing protection device is in an unstable equilibrium in the intermediate position where movement of the hearing protection device in a direction toward the active position or the inactive position automatically moves the hearing protection device from the intermediate position to the active position or the inactive position.

Clause 18. The hearing protection device according to any of clauses 14-17, wherein each of the first arm and the second arm has a rectilinear portion extending from the base in a direction toward the ear cup, and a curved portion extending from the rectilinear portion, with a lower end of the curved portion being pivotally connected to the ear cup.

Clause 19. The hearing protection device according to any of clauses 14-18, wherein the at least one connection member has a first branch connected to the base, a pair of junction portions connected to opposing ends of the first branch, and a second branch connected to the pair of junction portions, the second branch having a through slot separating the second branch into a first branch portion and a second branch portion.

Clause 20. The hearing protection device according to any of clauses 14-19, wherein the first branch is retained in a groove on the base such that the first branch is pivotable about a first axis, and wherein the first branch portion of the second branch is retained in a groove on the first arm and the second branch portion of the second branch is retained in a groove on the second arm such that the second branch is pivotable about a second axis different from the first axis.

Clause 21. The hearing protection device according to any of clauses 14-20, wherein the at least one first branch and the second branch are substantially parallel.

Clause 22. The hearing protection device according to any of clauses 14-21, further comprising an abutment system configured to limit displacement of the first and second arms relative to the base beyond at least one of the active position or the inactive position, the abutment system having a finger formed on the base and engaged in a cavity formed in at least one of the first arm and the second arm.

Clause 23. The hearing protection device according to any of clauses 14-22, wherein the cavity has a dihedral shape having an upper face and a lower face respectively forming a first abutment in the active position and a second abutment in the inactive position.

Clause 24. The hearing protection device according to any of clauses 14-23, wherein one of the first arm and the second arm has an appendage arranged outside the base and configured to guide a movement of one of the first arm and the second relative to the other of the first arm and the second arm.

Clause 25. A protective helmet, comprising: a shell; and a pair of hearing protection devices connected to opposing lateral portions of the shell, each hearing protection device comprising: a base connected to one of the lateral portions of the shell; an ear cup configured for covering an ear of a user; and a support connecting the ear cup to the base, wherein the support has a first arm and a second arm each having an upper part connected to the base by at least one connection member and a lower part connected to the ear cup, and wherein the at least one connection member is elastically deformable to allow relative movement of the upper part of the first arm relative to the upper part of the second arm.

Clause 26. The protective helmet according to clause 25, wherein the hearing protection device is movable between an active position, in which the ear cup is configured to cover the ear of the user, and an inactive position, in which the ear cup is configured to be spaced apart from the ear of the user.

Clause 27. The protective helmet according to clause 25 or 26, wherein the at least one connection member is configured to maintain the first and second arms in one of the active position or the inactive position in stable equilibrium.

Clause 28. The protective helmet according to any of clauses 25-27, wherein each hearing protection device is further movable to an intermediate position between the active position and the inactive position, and wherein the hearing protection device is in an unstable equilibrium in the intermediate position where movement of the hearing protection device in a direction toward the active position or the inactive position automatically moves the hearing protection device from the intermediate position to the active position or the inactive position.

Clause 29. The protective helmet according to any of clauses 25-28, wherein each of the first arm and the second arm has a rectilinear portion extending from the base in a direction toward the ear cup, and a curved portion extending from the rectilinear portion, with a lower end of the curved portion being pivotally connected to the ear cup.

Clause 30. The protective helmet according to any of clauses 25-29, wherein the at least one connection member has a first branch connected to the base, a pair of junction portions connected to opposing ends of the first branch, and a second branch connected to the pair of junction portions, the second branch having a through slot separating the second branch into a first branch portion and a second branch portion.

Clause 31. The protective helmet according to any of clauses 25-30, wherein the first branch is retained in a groove on the base such that the first branch is pivotable about a first axis, and wherein the first branch portion of the second branch is retained in a groove on the first arm and the second branch portion of the second branch is retained in a groove on the second arm such that the second branch is pivotable about a second axis different from the first axis.

Clause 32. The protective helmet according to any of clauses 25-31, further comprising an abutment system configured to limit displacement of the first and second arms relative to the base beyond at least one of the active position or the inactive position, the abutment system having a finger formed on the base and engaged in a cavity formed in at least one of the first arm and the second arm.

Clause 33. The protective helmet according to any of clauses 25-32, wherein the cavity has a dihedral shape having an upper face and a lower face respectively forming a first abutment in the active position and a second abutment in the inactive position.

The features that characterize the present disclosure are pointed out with particularity in the claims, which are annexed to and form a part of this disclosure. These and other features of the disclosure, its operating advantages, and the specific objects obtained by its use will be more fully understood from the following detailed description in which non-limiting examples of the disclosure are illustrated and described.

BRIEF DESCRIPTION OF THE DRAWINGS

In FIGS. 1-13, like characters refer to the same components and elements, as the case may be, unless otherwise stated.

DETAILED DESCRIPTION OF THE DISCLOSURE

Figure 1:
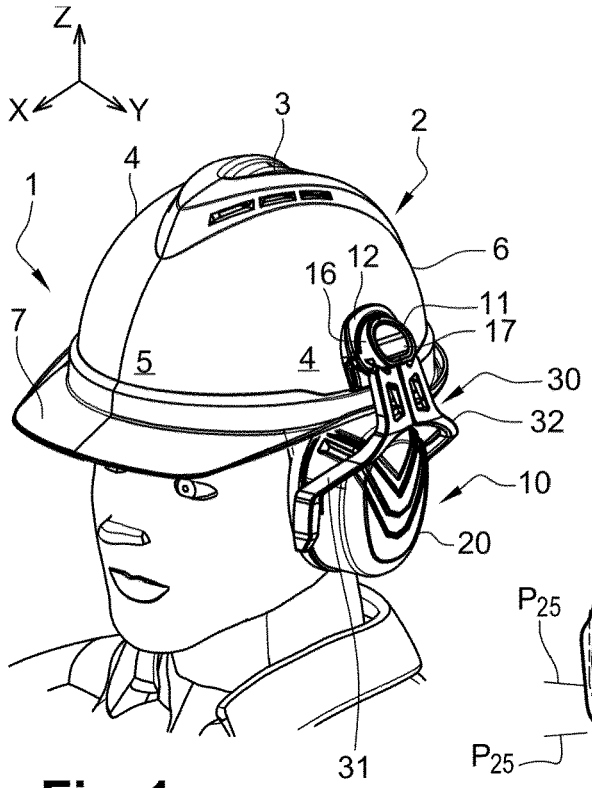
FIG. 1 is a perspective view of a user wearing a protective helmet according to one embodiment or aspect of the present disclosure, the helmet including two hearing protection devices.

As used herein, the singular form of "a", "an", and "the" include plural referents unless the context clearly dictates otherwise.

Spatial or directional terms, such as "left", "right", "inner", "outer", "above", "below", and the like, relate to the invention as shown in the drawing figures and are not to be considered as limiting as the invention can assume various alternative orientations.

All numbers used in the specification and claims are to be understood as being modified in all instances by the term "about". By "about" is meant plus or minus twenty-five percent of the stated value, such as plus or minus ten percent of the stated value. However, this should not be considered as limiting to any analysis of the values under the doctrine of equivalents.

Unless otherwise indicated, all ranges or ratios disclosed herein are to be understood to encompass the beginning and ending values and any and all subranges or subratios subsumed therein. For example, a stated range or ratio of "1 to 10" should be considered to include any and all subranges or subratios between (and inclusive of) the minimum value of 1 and the maximum value of 10; that is, all subranges or subratios beginning with a minimum value of 1 or more and ending with a maximum value of 10 or less. The ranges and/or ratios disclosed herein represent the average values over the specified range and/or ratio.

The terms "first", "second", and the like are not intended to refer to any particular order or chronology, but refer to different conditions, properties, or elements.

All documents referred to herein are incorporated by reference in their entirety.

The term "at least" is synonymous with "greater than or equal to".

As used herein, "at least one of" is synonymous with "one or more of". For example, the phrase "at least one of A, B, or C" means any one of A, B, or C, or any combination of any two or more of A, B, or C. For example, "at least one of A, B, or C" includes A alone; or B alone; or C alone; or A and B; or A and C; or B and C; or all of A, B, and C.

The term "includes" is synonymous with "comprises".

As used herein, the terms "parallel" or "substantially parallel" mean a relative angle as between two objects (if extended to theoretical intersection), such as elongated objects and including reference lines, that is from 0° to 5°, or from 0° to 3°, or from 0° to 2°, or from 0° to 1°, or from 0° to 0.5°, or from 0° to 0.25°, or from 0° to 0.1°, inclusive of the recited values.

As used herein, the terms "perpendicular", "orthogonal", "substantially perpendicular", or "substantially orthogonal" mean a relative angle as between two objects at their real or theoretical intersection is from 85° to 90°, or from 87° to 90°, or from 88° to 90°, or from 89° to 90°, or from 89.5° to 90°, or from 89.75° to 90°, or from 89.9° to 90°, inclusive of the recited values.

As used herein, the term "rigid" means that the arms are practically non-deformable under normal conditions of use.

As used herein, the term "semi-rigid" means that the connection member has both rigidity and flexibility characteristics. More precisely, the connection member is rigid enough to maintain the arm relative to the base, that is to say in particular to prevent the arm from falling under the effect of its own weight or from displacing in directions parallel to the bearing surface. In addition, the connection member is flexible enough to authorize the relative movement described above, under normal conditions of use.

The disclosure comprises, consists of, or consists essentially of, the following examples or aspects, in any combination. Various examples or aspects of the disclosure are illustrated in separate drawing figures. However, it is to be understood that this is simply for ease of illustration and discussion. In the practice of the disclosure, one or more examples or aspects shown in one drawing figure can be combined with one or more examples or aspects shown in one or more of the other drawing figures.

FIG. 1 shows a user wearing a protective helmet 1 which includes a shell 2 intended to protect the head of the user. The description will be made when the helmet 1 is in the position illustrated in FIG. 1, that is to say when the wearer is standing with the head straight. This position defines the vertical direction Z, the longitudinal direction X as the front-back horizontal direction, and the transverse direction Y as the left-right horizontal direction.

In some non-limiting embodiments or aspects, the shell 2 includes an upper portion 3, two lateral portions 4 (respectively left and right), a front portion 5 and a rear portion 6. The shell 2 can also include a visor 7. The shell can be made by molding a plastic material. Inside the shell 2 there can be mounted a cap intended to damp possible shocks and/or a ring allowing adaptation to the head of the user, in particular by adjusting the circumference.

The protective helmet 1 further has two hearing protection devices 10 each assembled to a lateral portion 4 of the shell 2. These two hearing protection devices 10 may be identical and mounted on the shell 2 symmetrically relative to a median plane P1 parallel to (X, Z). In FIG. 1, because of the perspective, only one hearing protection device 10 is visible.

In some non-limiting embodiments or aspects, the hearing protection device 10 has a plane of symmetry P2 substantially parallel to a plane (Y, Z).

The hearing protection device 10 has a base 11 intended to be assembled to the shell 2. To this end, the base 11 is equipped with means for assembly to the shell 2, for example in the form of orifices formed in a flange 12 of the base 11 in which screws or other fastening means on the shell 2 can be engaged. Alternatively, the shell 2 could be assembled to the shell by gluing, welding, etc. Furthermore, the base 11 includes a bearing face 13 on the shell 2, this bearing face 13 preferably having a shape complementary to that of the corresponding face of the shell 2. In so far as the base 11 is assembled to a curved surface, namely a lateral portion 4 of the shell 2, the bearing face 13 in turn may not be planar.

In some non-limiting embodiments or aspects, the base 11 has a peripheral wall 14 which extends from the bearing face 13 in the direction opposite to the shell 2, and which can be substantially cylindrical. In its lower face, preferably in the lower part of its peripheral wall 14, the base 11 includes at least one orifice 15 whose function will be explained below. The base 11 can include a casing 16 including the bearing face 13 and the peripheral wall 14, the casing 16 being open opposite the bearing face 13, and a cover 17.

The hearing protection device 10 also has an ear cup 20 able to cover an ear of the user. The cup 20 can include a rigid shell 21 defining a cavity having an annular edge 25 substantially located in a plane P25. On the annular edge 25 is mounted a comfort flexible ring 22 intended to be in contact with the face of the user, around the ear.

The hearing protection device 10 has a support 30 linking the base and the ear cup 20. The support 30 is formed of two, respectively front and rear, distinct arms 31, 32. As used herein, "distinct" means that the arms are not integrally made. The arms 31, 32 are preferably rigid, that is to say, they do not become deformed under normal conditions of use.

Figure 5:
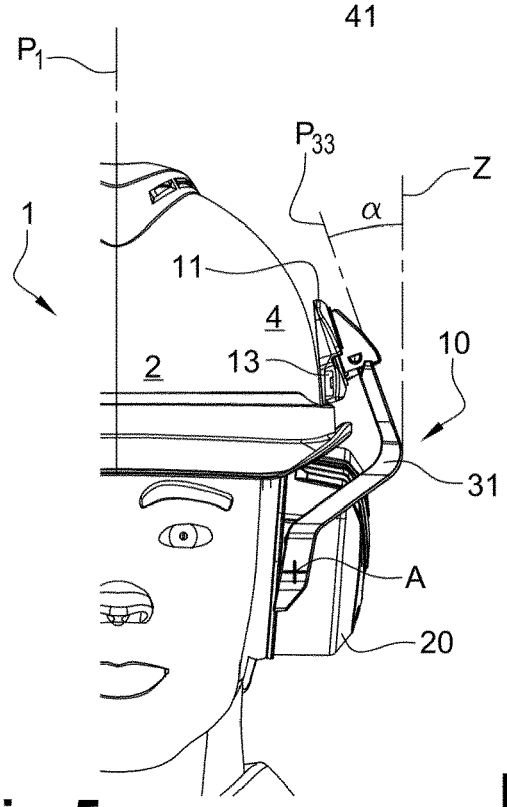
FIG. 5 shows the user of FIG. 1 with the hearing protection device in an active position.
Figure 6:
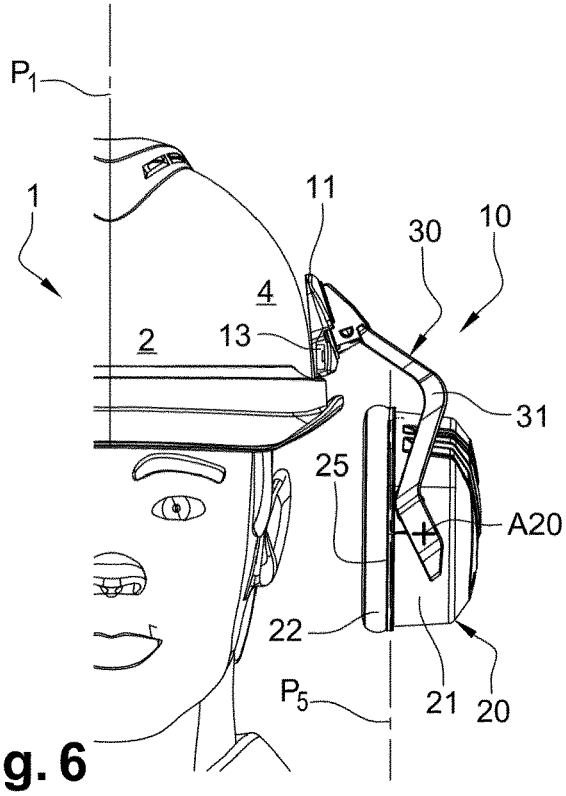
FIG. 6 shows the user of FIG. 1 with the hearing protection device in an inactive position.

In some non-limiting embodiments or aspects, the hearing protection device 10 can occupy: an active position, in which the cup 20 is in contact with the face of the user and covers one of his ears (FIG. 5); or an inactive position, in which the cup 20 is located at a distance from the face of the user (FIG. 6). The neutral position of use is defined as the position where the protective helmet 1 is worn, with the hearing protection devices 10 in the active position, without offset between the arms 31, 32 orthogonally to the bearing face 13 of the base 11 (position illustrated in FIG. 5).

The upper part of the arms 31, 32 is connected to the base 11 by a connection device. More precisely, the connection device has at least one connection member 50 which links the upper part of an arm, and preferably of the two arms 31, 32, to the base 11. The lower part of the arms 31, 32 is connected to the cup 20.

In some non-limiting embodiments or aspects, the connection member 50 is housed in the base 11, as described herein. Thus, the arms 31, 32 are engaged in the orifice(s) 15 of the lower face of the base 11 so that their upper part is at least partially located in the base 11 and can cooperate with the connection member 50.

In some non-limiting embodiments or aspects, each arm 31, 32 has a rectilinear portion 33 extending from the base 11 to the cup 20. The rectilinear portion 33 can be substantially planar. In the neutral position of use, as predefined, the rectilinear portions 33 of the two arms 31, 32 can be substantially coplanar and substantially adjacent, that is to say, separated along the longitudinal direction X by a very small distance, generally less than 5 mm, or even less than 3 mm. In the neutral position of use, and as illustrated in FIG. 5, the rectilinear portions 33 can be located in a plane P33 parallel to the direction X and inclined relative to the direction Z by an angle $\alpha$ comprised between 10 and 30°, for example close to 20°, extending away from the shell 2 from top to bottom.

In some non-limiting embodiments or aspects, each arm 31, 32 can further have a curved portion 34 which extends the rectilinear portion 33 and whose lower end is connected to the cup 20 pivotally about a substantially longitudinal axis A20. The lower end of the front arm 31 is mounted at the front face 23, and the lower end of the rear arm 32 is mounted at the rear face 24 of the cup 20. The curved portion of the front arm 31 and the curved portion of the rear arm 32 form an arch around the cup 20.

Figure 9:
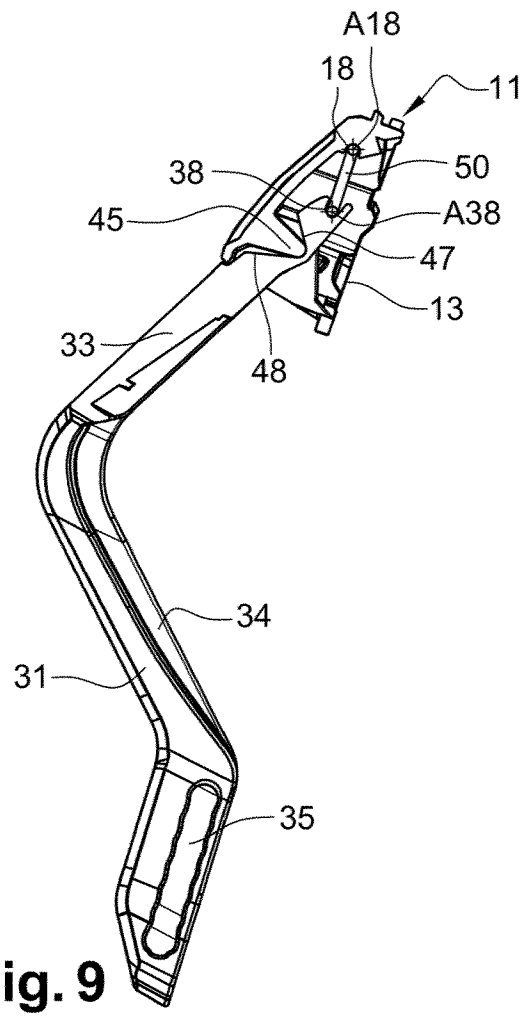
FIG. 9 shows the base and the support of the hearing protection device in the inactive position.
Figure 8:
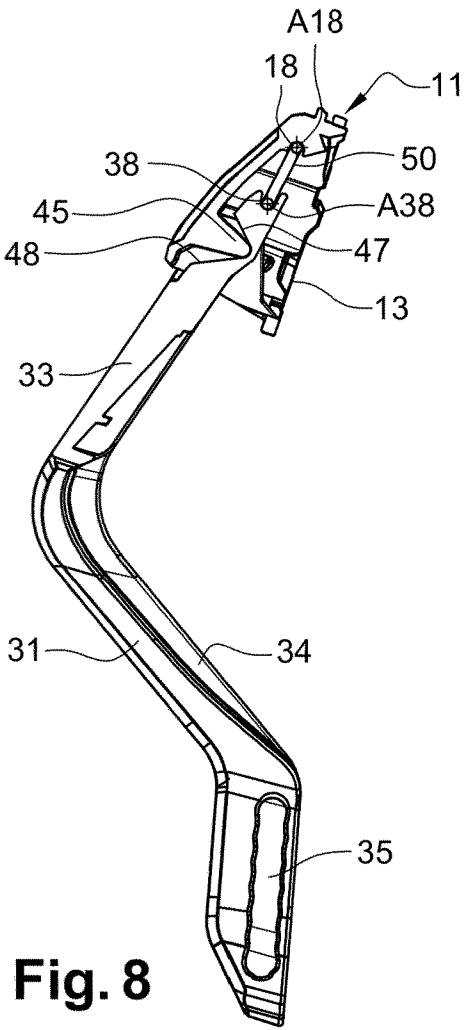
FIG. 8 shows the base and the support of the hearing protection device in an intermediate active position.
Figure 7:
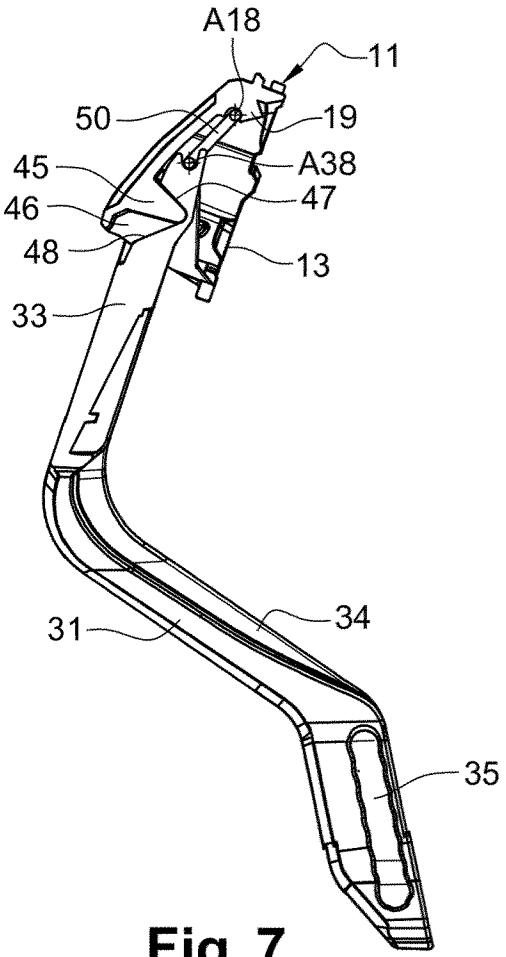
FIG. 7 shows the base and the support of the hearing protection device in the active position.

As can be seen in FIGS. 7-9, the arms 31, 32 can include an oblong opening 35 in their lower part, located in line with a front 23 or rear 24 face of the cup 20. The oblong opening 35 allows adjusting the position of the axis A20, depending on the morphology of the face of the user.

The connection member 50 that allows connecting the upper part of the arms 31, 32 to the base 11, as described herein. The connection member 50 is semi-rigid. It is thus rigid enough to ensure maintaining the arm 31, 32 relative to the base 11. It is in addition flexible enough to be elastically deformed so as to allow relative movement of the upper part of an arm 31, 32 relative to the upper part of the other arm 32, 31 substantially orthogonally to the bearing face 13 of the base 11.

Figure 4:
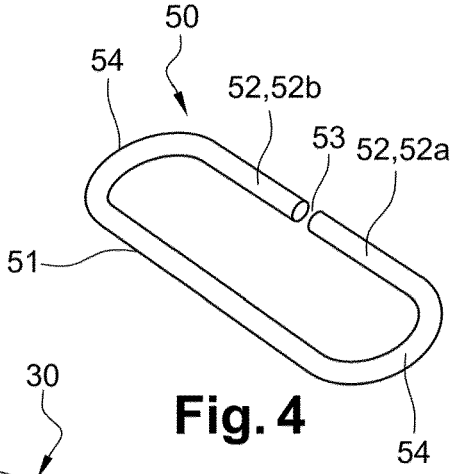
FIG. 4 shows a connection member for the hearing protection device.

In some non-limiting embodiments or aspects, the connection member 50 can be as illustrated in FIG. 4. It can thus be in the form of a loop, such as an oblong loop, having a first branch 51 assembled to the base 11 and a second branch 52 assembled to the upper part of each of the two arms 31, 32. The second branch 52 has a through-slot 53, for example a substantially centered through-slot, which is located between the two arms 31, 32 as seen in FIG. 4. The second branch 52 thus has two portions 52*a*, 52*b*. The branches 51, 52, which can be straight and parallel, are linked by two junction portions 54. The junction portions 54 can be curved. The connection member 50 can be planar.

In some non-limiting embodiments or aspects, the connection member 50 could have other geometries as long as they allow fulfilling the same function in an appropriate manner Thus, there can be used, for example, spring blades, a helical compression spring, etc.

In some non-limiting embodiments or aspects, the connection member 50 may be made of metal. Alternatively, the connection member 50 may be made of composite material. The connection member 50 may be designed to retain its elastic deformation properties under stress, in time, and in environments where the temperature may vary for example between −30° C. and +60° C.

Figure 3:
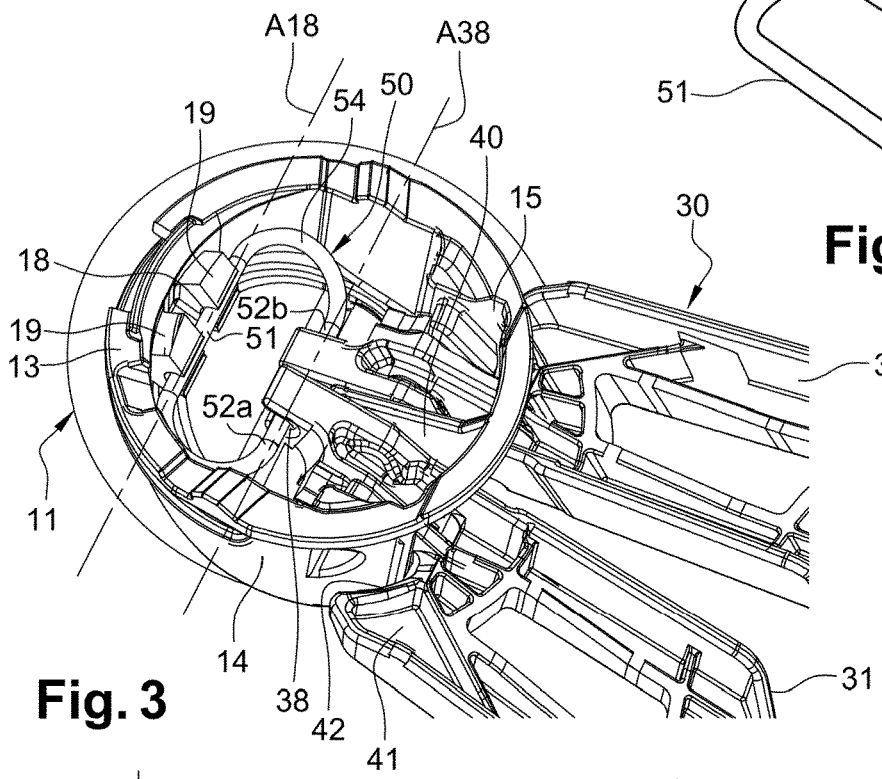
FIG. 3 is a detailed view of the base and an upper part of the support.

As seen in FIG. 3, the connection member 50 can be fixed inside the base 11, and in the upper part thereof. For example, the first branch 51 of the connection member 50 can be clipped into a groove 18 of the base 11. The groove 18 may be formed in one or more part(s) 19 protruding towards the inside of the base 11. The groove 18 has an axis A18 substantially longitudinally oriented (see FIG. 7), which corresponds to the axis of the first branch 51 of the connection member 50.

Furthermore, the second branch 52 of the connection member 50 is for example clipped into a groove 38 of the upper part of each of the arms 31, 32. More precisely, the portion 52*a* of the second branch 52 is clipped into the groove 38 of the front arm 31, and the portion 52*b* of the second branch 52, on the other side of the slot 53, is clipped into the groove 38 of the rear arm 32. The grooves 38 are open towards the inside of the base, that is to say in the direction of the grooves 18. The grooves 38 have a same axis A38 substantially longitudinally oriented (see FIG. 7), which corresponds to the axis of the second branch 52 of the connection member 50.

In some non-limiting embodiments or aspects, the first branch 51 of the connection member 50 can pivot in the groove 18 about the axis A18 and the second branch 52 of the connection member 50 can pivot in the groove 38 about the axis A38. This allows switching the hearing protection device 10 from the active position to the inactive position and vice versa. In addition, this allows maintaining the arms 31, 32 in one or the other of these positions in stable equilibrium.

FIG. 7 shows the base 11 and the support 30 of the hearing protection device 10 in the active position.

In some non-limiting embodiments or aspects, when the user wishes to switch the hearing protection device 10 to the inactive position, he laterally pulls the cup 20 and/or the arms 31, 32, optionally in combination with an upward movement. This results in a pivoting of the arms 31, 32 relative to the base 11 to the inactive position, illustrated in FIG. 9.

FIG. 8 shows an intermediate position between the active and inactive positions. In any intermediate position, the connection member 50 is compressed between the grooves 18, 38 and thus exerts a force tending to space the branches 51, 52 apart from each other. The position of FIG. 8 corresponds to an unstable equilibrium position, where a slight movement of the arm 31, 32 in the direction of the face or extending away from the face, automatically switches the arm 31, 32 to the active or inactive position, respectively. In the active and/or inactive position, the connection member 50 can be in the unstressed state (that is to say neither compressed nor stretched).

In some non-limiting embodiments or aspects, there can be provided an abutment system configured to limit the displacement of the arms 31,32 relative to the base 11 beyond the active position and/or beyond the inactive position. As seen in FIGS. 7-9, this abutment system can include a finger 45 formed on the base 11 and engaged in a cavity 46 formed in at least one arm 31, 32. The cavity 46 can have a dihedral shape having an upper face 47 and a lower face 48 respectively forming an abutment in the active position (FIG. 7) and an abutment in the inactive position (FIG. 8).

In some non-limiting embodiments or aspects, a connection device described herein allows ensuring excellent contact between the cups 20 and the face of the user, by adapting to different face shapes. As a result, the hearing protection device 10 has a considerably improved performance.

Indeed, when the hearing protection device 10 is in the active position, it is designed to press on the face with a certain pressure, in particular because of the shape of the arms 31, 32 and of the presence and mounting of the connection member 50.

Figure 11:
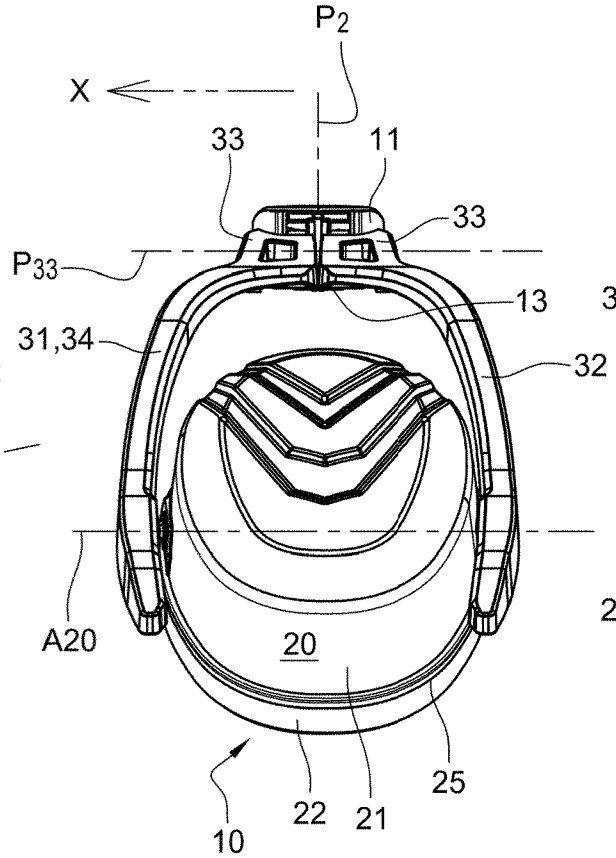

In the neutral position, the cup 20 is oriented so that the plane P25 of the annular edge 25 of the cavity formed by the cup 20 is substantially parallel to a plane (X, Z), or slightly inclined towards P1 to adapt to the convergent shape of the bottom of the face (see FIG. 5). In this case, as illustrated in FIG. 11, the two arms 31, 32 are symmetrical relative to the plane P2. Particularly, the rectilinear portions 33 of both arms 31, 32 are located in a same plane P33.

Figure 12:
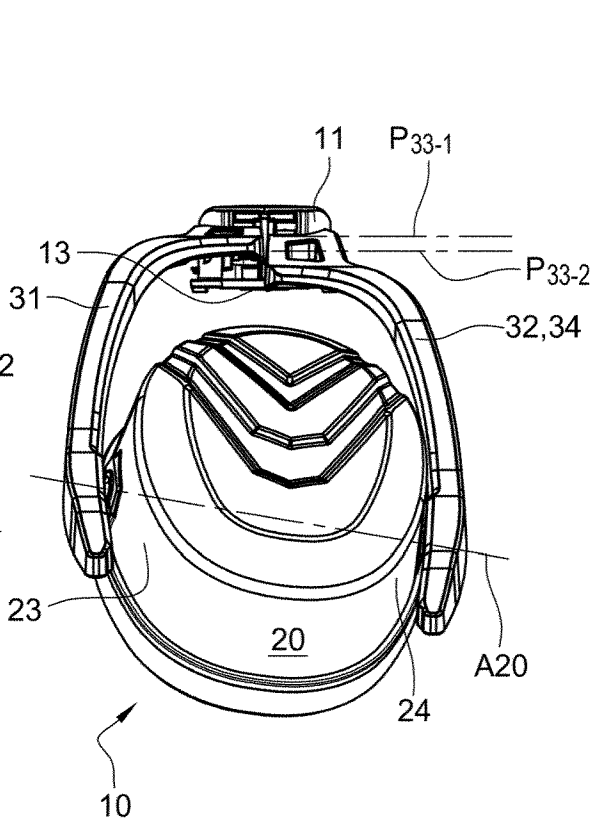
FIGS. 10-12 are side views of the hearing protection device showing various movements of the arms and the cup.
Figure 10:
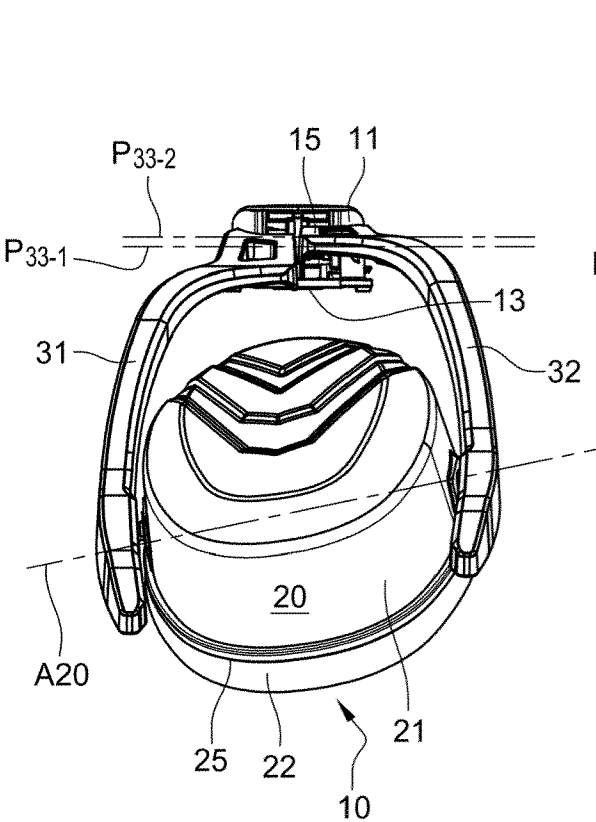

Based to the shape of the user's face, when the cup 20 is applied against the face, it can be slightly displaced relative to the neutral position. More specifically, the cup 20 can occupy a position resulting from a rotation, from the neutral position, about a vertical axis, that can pass through the axis A20 or close thereto. This rotation can be carried out in one direction or the other (FIG. 10 and FIG. 12), according to the shape of the user's face. The amplitude of this rotation can be in the range of −10° to +10°, or even −15° to +15° (angles γ and γ' illustrated in FIG. 13).

This movement of the cup 20, ensuring a good contact with the face, is made possible by the possibility that the arms 31, 32 have to move relative to each other, since the connection member 50 connects them to the base 11. There can in addition be a pivoting movement of the first branch 51 of the connection member 50 in the groove 18 of the base 11.

In some non-limiting embodiments or aspects, the connection member 50, because of its relative flexibility and of the slot 53 conferring a certain independence to the arms 31, 32, allows the upper part of an arm 31, 32 to move relative to the other arm 32, 31, substantially orthogonally to the bearing face 13 of the base 11. Thus, following such a relative movement, the rectilinear portion 33 of the front arm 31 is located in a plane P33-1 which is offset—in a direction orthogonal to the bearing face 13 of the base 11—relative to the plane P33-2 in which the rectilinear portion 33 of the rear arm 32 is located.

Figure 2:
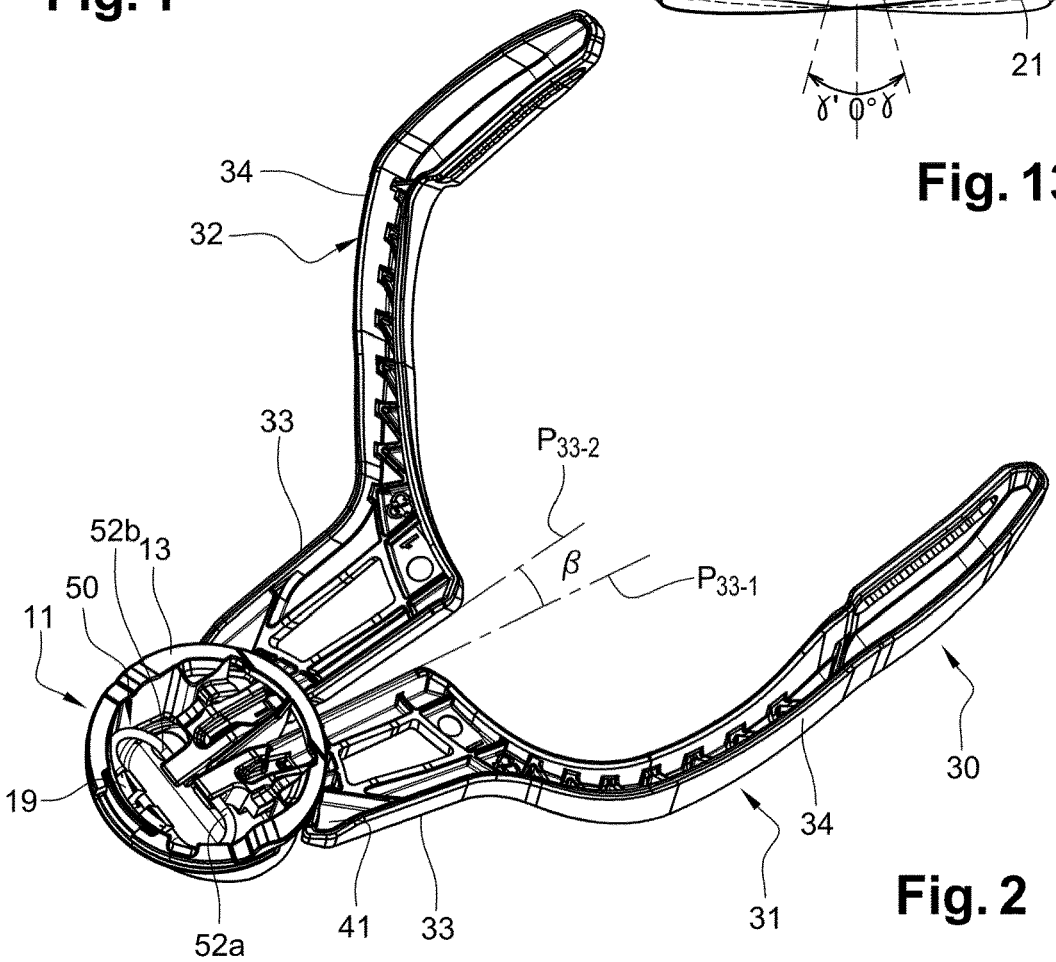
FIG. 2 is a perspective view of a base and a support of a hearing protection device.

The offset between the portions 52*a* and 52*b* of the second branch 52 of the connection member 50 is visible in FIG. 2. In addition to this offset in a direction orthogonal to the bearing face 13, the planes P33-1 and P33-2 form therebetween an angle β, as seen in FIG. 2. In practice, the offset between the ends of the portions 52*a* and 52*b*, on both sides of the slot 53, substantially orthogonally to the mean plane of the connection member 50 can be at most 1 to 2 mm.

In some non-limiting embodiments or aspects, the upper part of a single arm can be displaced relative to the neutral position, that is to say relative to the plane P33, or that the upper parts of the two arms can be displaced—in different directions—relative to the neutral position.

In some non-limiting embodiments or aspects, the orifice 15 formed in the base 11, and in which the arms 31, 32 are engaged, is large enough to authorize this relative movement between the upper parts of the arms 31, 32.

By way of example, the angle β can be in the order of 8° to 15°, for example in the order of 10°.

In some non-limiting embodiments or aspects, the connection member 50 may be designed, due to its stiffness, to prevent relative movement of very large amplitude between the arms 31, 32. Indeed, this could cause twists which would be detrimental to the smoothness of displacement of the arms 31, 32 between active and inactive positions.

Figure 13:
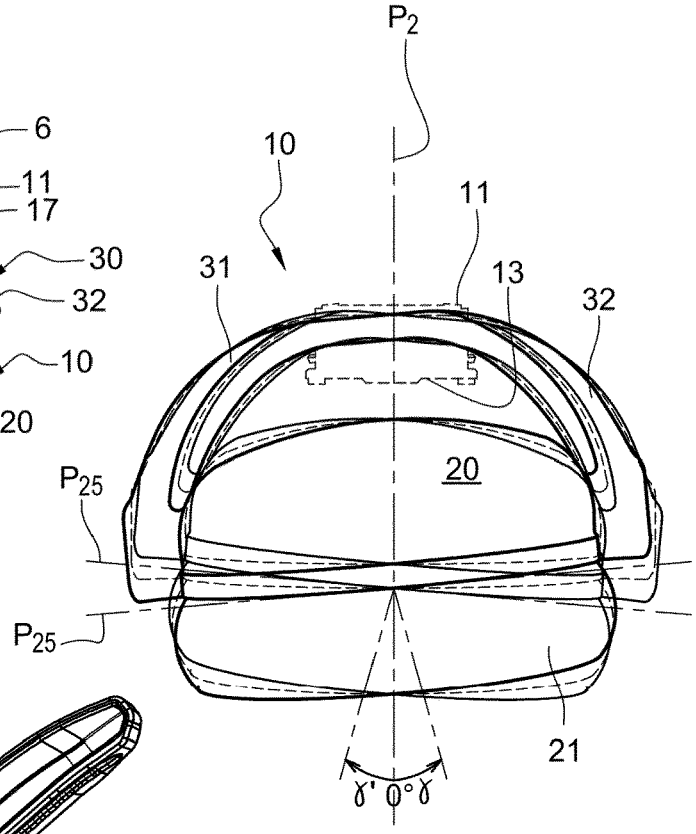
FIG. 13 is a top view of the hearing protection device showing, in a superimposed manner, the possible movements of the arms and the cup shown in FIGS. 1-12.

FIG. 13 shows in a superimposed manner the neutral position of the cup 20, and the extreme positions of displacement in one direction and in the opposite direction. In all these possible active positions, that is to say regardless of the morphology or the size of the user's head, the hearing protection device allows ensuring the pressure required for obtaining a satisfactory acoustic sealing, i.e. a value of 8 to 14 N with regard to the force applied to the face.

Furthermore, in the inactive position, the cups 20 are no longer in contact with the face of the user but remain accessible and positioned on standby, for future use. Moreover, as seen in FIGS. 2-3, there can be provided means for guiding the displacement of the arms 31, 32. Thus, a partition 40 can be provided inside the base 11, between the arms 31, 32, preferably comprised in the plane P2.

Alternatively or additionally, the arms 31, 32 can include an appendage 41 arranged outside the base 11. The appendage 41 has a face 42 located opposite and in close proximity to an outer face of the base 11. Preferably, The face 42 of the appendage 41 and the corresponding face (here the peripheral wall 14) of the base 11 have complementary shapes, namely cylindrical in the embodiment described by way of example.

In some non-limiting embodiments or aspects, this appendage 41 thus allows guiding the relative movement of the arm that carries it relative to the base 11, and therefore relative to the other arm. Preferably, The appendage 41 prevents rotation of the arm that carries it relative to the base 11 about an axis other than the axis A38.

In some non-limiting embodiments or aspects, the present disclosure brings a decisive improvement to the prior art, by providing a hearing protection device which, due to the relative independence of the arms belonging to the support of the cups, and to the pressure applied against the face by the cups, ensures good adaptability to the face and therefore increased hearing protection performances.

In some non-limiting embodiments or aspects, the rigidity of the support guarantees easy and smooth switching between active and inactive positions, without degradation of acoustic properties in the active position, thanks to the freedom of movement imparted by the connection member.

In some non-limiting embodiments or aspects, the present disclosure allows satisfying two requirements of hearing protection devices which was not possible to reconcile with the hearing protection devices of the prior art.

From a general mechanical point of view, the dissociation of the two arms from the support gives the hearing protection device a capacity of bending about a vertical axis of rotation, for adaptation of the cups to the face, while preserving the rigidity about a horizontal axis, for easy handling and for smooth operation of the bistable mechanism switching between active and inactive positions.

The present disclosure is not limited to the embodiments or aspects described herein, but it includes all the technical equivalents and variants of the described features as well as their combinations. For example, the connection device comprises two distinct connection members, each connection member being U-shaped and having a first branch assembled to the base and a second branch assembled to the upper part of one of the two arms. It will be readily appreciated by those skilled in the art that various modifications may be made to the disclosure without departing from the concepts disclosed in the foregoing description. Accordingly, the particular embodiments or aspects described in detail herein are illustrative only and are not limiting to the scope of the disclosure, which is to be given the full breadth of the appended claims and any and all equivalents thereof.

The invention claimed is:

1. A hearing protection device, comprising:

a base configured for connecting to a lateral portion of a protective helmet;

an ear cup configured for covering an ear of a user; and a support connecting the ear cup to the base, wherein the support has a first arm and a second arm each having an upper part connected to the base by at least one connection member and a lower part connected to the ear cup, wherein the at least one connection member comprises a first branch connected to the base, a second branch connected to the first arm or the second arm, and one or more junction portions linking the first and second branches, such that the at least one connection member is elastically deformable to allow relative movement of the upper part of the first arm relative to the upper part of the second arm.

2. The hearing protection device according to claim 1, wherein the at least one connection member is configured to maintain the first and second arms in one of the active position or the inactive position in stable equilibrium.

3. The hearing protection device according to claim 1, wherein the hearing protection device is further movable to an intermediate position between the active position and the inactive position, and wherein the hearing protection device is in an unstable equilibrium in the intermediate position where movement of the hearing protection device in a direction toward the active position or the inactive position automatically moves the hearing protection device from the intermediate position to the active position or the inactive position.

4. The hearing protection device according to claim 1, wherein each of the first arm and the second arm has a rectilinear portion extending from the base in a direction toward the ear cup, and a curved portion extending from the rectilinear portion, with a lower end of the curved portion being pivotally connected to the ear cup.

5. The hearing protection device according to claim 1, wherein the one or more junction portions connect to opposing ends of the first branch, and the second branch connects to the one or more junction portions, the second branch having a through slot separating the second branch into a first branch portion and a second branch portion.

6. The hearing protection device according to claim 5, wherein the first branch is retained in a groove on the base such that the first branch is pivotable about a first axis, and wherein the first branch portion of the second branch is retained in a groove on the first arm and the second branch portion of the second branch is retained in a groove on the second arm such that the second branch is pivotable about a second axis different from the first axis.

7. The hearing protection device according to claim 5, wherein the first branch and the second branch are substantially parallel.

8. The hearing protection device according to claim 1, further comprising an abutment system configured to limit displacement of the first and second arms relative to the base beyond at least one of the active position or the inactive position, the abutment system having a finger formed on the base and engaged in a cavity formed in at least one of the first arm and the second arm.

9. The hearing protection device according to claim 8, wherein the cavity has a dihedral shape having an upper face and a lower face respectively forming a first abutment in the active position and a second abutment in the inactive position.

10. The hearing protection device according to claim 1, wherein one of the first arm and the second arm has an appendage arranged outside the base and configured to guide a movement of one of the first arm and the second relative to the other of the first arm and the second arm.

11. The protective helmet according to claim 1, wherein the ear cup is movable in a lateral direction between an active position in which the ear cup is configured to cover the ear of the user and an inactive position in which the ear cup is configured to be spaced apart from the ear of the user.

12. A protective helmet, comprising:

a shell; and a pair of hearing protection devices connected to opposing lateral portions of the shell, each hearing protection device comprising:

a base connected to one of the lateral portions of the shell; an ear cup configured for covering an ear of a user; and a support connecting the ear cup to the base, wherein the support has a first arm and a second arm each having an upper part connected to the base by at least one connection member and a lower part connected to the ear cup, wherein the at least one connection member comprises a first branch connected to the base, a second branch connected the first arm or the second arm, and one or more junction portions linking the first and second branches, such that the at least one connection member is elastically deformable to allow relative movement of the upper part of the first arm relative to the upper part of the second arm.

13. The protective helmet according to claim 12, wherein the at least one connection member is configured to maintain the first and second arms in one of the active position or the inactive position in stable equilibrium.

14. The protective helmet according to claim 12, wherein each hearing protection device is further movable to an intermediate position between the active position and the inactive position, and wherein the hearing protection device is in an unstable equilibrium in the intermediate position where movement of the hearing protection device in a direction toward the active position or the inactive position automatically moves the hearing protection device from the intermediate position to the active position or the inactive position.

15. The protective helmet according to claim 12, wherein each of the first arm and the second arm has a rectilinear portion extending from the base in a direction toward the ear cup, and a curved portion extending from the rectilinear portion, with a lower end of the curved portion being pivotally connected to the ear cup.

16. The protective helmet of claim 12, wherein, the one or more junction portions connect to opposing ends of the first branch, and the second branch connects to the one or more junction portions, the second branch having a through slot separating the second branch into a first branch portion and a second branch portion.

17. The protective helmet according to claim 16, wherein the first branch is retained in a groove on the base such that the first branch is pivotable about a first axis, and wherein the first branch portion of the second branch is retained in a groove on the first arm and the second branch portion of the second branch is retained in a groove on the second arm such that the second branch is pivotable about a second axis different from the first axis.

18. The protective helmet according to claim 12, further comprising an abutment system configured to limit displacement of the first and second arms relative to the base beyond at least one of the active position or the inactive position, the abutment system having a finger formed on the base and engaged in a cavity formed in at least one of the first arm and the second arm.

19. The protective helmet according to claim 18, wherein the cavity has a dihedral shape having an upper face and a lower face respectively forming a first abutment in the active position and a second abutment in the inactive position.

20. The protective helmet according to claim 12, wherein the ear cup is movable in a lateral direction between an active position in which the ear cup is configured to cover the ear of the user and an inactive position in which the ear cup is configured to be spaced apart from the ear of the user.

21. A hearing protection device, comprising:

a base configured for connecting to a lateral portion of a protective helmet;

an ear cup configured for covering an ear of a user; and a support connecting the ear cup to the base, wherein the support has a first arm and a second arm each having an upper part connected to the base by at least one connection member and a lower part connected to the ear cup, wherein the at least one connection member comprises a first branch connected to the base, a second branch connected to the upper part of the first and second arms, and one or more junction portions linking the first and second branches, and wherein the first branch is configured to pivot in a groove of the base and the second branch is configured to pivot in a groove of the first arm and the second arm, allowing the ear cup to move in a lateral direction between an active position in which the ear cup is configured to cover the ear of the user and an inactive position in which the ear cup is configured to be spaced apart from the ear of the user.

* * * * *